US007350240B2

(12) United States Patent
LaGrone

(10) Patent No.: US 7,350,240 B2
(45) Date of Patent: Apr. 1, 2008

(54) SHOEING APRON

(76) Inventor: Michael A. LaGrone, 25150 S. 385th W. Ave., Bristow, OK (US) 74010

( * ) Notice: Subject to any disclaimer, the term of this patent is extended or adjusted under 35 U.S.C. 154(b) by 0 days.

(21) Appl. No.: 11/263,739

(22) Filed: Nov. 1, 2005

(65) Prior Publication Data

US 2007/0118949 A1 May 31, 2007

(51) Int. Cl.
*A41D 13/00* (2006.01)

(52) U.S. Cl. ..... 2/51; 2/22; 2/2.5

(58) Field of Classification Search ..... 2/51, 2/23, 24, 48, 22, 46, 47, 2.5, 466; 168/45
See application file for complete search history.

(56) References Cited

U.S. PATENT DOCUMENTS

| | | | | | |
|---|---|---|---|---|---|
| 562,608 | A * | 6/1896 | Herbelin | 2/24 |
| 588,907 | A * | 8/1897 | Herbelin | 2/24 |
| 952,179 | A * | 3/1910 | Beckmann | 2/51 |
| 1,225,799 | A * | 5/1917 | Goldsmith | 2/23 |
| 1,598,041 | A * | 8/1926 | Bloom et al. | 442/190 |
| 1,659,100 | A * | 2/1928 | Hardage | 2/23 |
| 1,772,923 | A * | 8/1930 | Volz | 2/22 |
| 3,953,893 | A * | 5/1976 | Byrnes, Sr. | 2/51 |
| 4,351,065 | A * | 9/1982 | Bouchard | 2/23 |
| 4,561,123 | A * | 12/1985 | Hull | 2/23 |
| 4,613,991 | A * | 9/1986 | Grover | 2/23 |
| 4,688,269 | A * | 8/1987 | Maeshima | 2/456 |
| 5,375,262 | A * | 12/1994 | Carter | 2/23 |
| 5,729,832 | A * | 3/1998 | Grilliot et al. | 2/23 |
| 6,202,215 | B1 * | 3/2001 | Sauter | 2/51 |
| 6,338,164 | B1 * | 1/2002 | Howard | 2/242 |
| 6,519,775 | B1 * | 2/2003 | Garcia | 2/22 |
| 6,839,917 | B1 * | 1/2005 | Landwehr | 2/455 |

OTHER PUBLICATIONS

PCT International Search Report dated Jan. 19, 2007.

* cited by examiner

*Primary Examiner*—A. Vanatta
(74) *Attorney, Agent, or Firm*—Gable Gotwals

(57) ABSTRACT

An apron for use in shoeing horses or in other activities in which there is a likelihood that a tool might puncture the thigh portion of a person's clothing has detachable thigh pads. The apron is washable, air permeable and lightweight in comparison to the pads. The pads, preferably leather, are puncture resistant, identically shaped and symmetrical about vertical and horizontal axes. The attachment mechanisms, such as mating segments of hook and loop material, are positioned so that the pads are interchangeable on the coverings. Thus, damaged pads can be rotated, switched or replaced on one lightweight apron, maximizing pad use and minimizing packing space for travel.

17 Claims, 4 Drawing Sheets

SHOEING APRON

BACKGROUND OF THE INVENTION

This invention relates generally to equipment used in tending to the hooves of animals and more particularly concerns an apron to be worn while shoeing horses.

While horse-shoeing is an old trade, the evolution of horse-shoeing aprons has been quite modest. Leather, chap-like aprons have been most commonly used over the years and serve their protective purpose well for as long as they remain serviceable. However, horse-shoers tend to develop their own unique and repeatable styles of performing their trade. As a result, each shoer generally consistently positions the animals' hooves in the same position in relation to the thigh areas of the apron. The purpose of the leather is to resist penetration of a shoeing tool through the apron to the thigh of the shoer. Once the first such penetration occurs, a permanent hole is created in precisely the spot that the next penetration will most likely occur. As a result, shoeing aprons generally are no longer serviceable after this first occurrence and are discarded. The cost of a new leather apron is considerable in comparison to the fees that can be charged for the shoeing. Moreover, for as long as they are serviceable, cleaning and maintaining leather aprons is difficult and time consuming or, in an unfortunate alternative, simply does not happen. They also take up considerable storage or travel bag space.

More recently, in order to reduce the cost of the aprons, to lighten the aprons—perhaps for comfort or perhaps in deference to airplane baggage weight limitations—or to increase the comfort of the shoer while working, the aprons are made of a non-leather material selected for price, weight or air-permeability, or some compromise of these characteristics. Leather pads are then sewn onto the non-leather aprons to afford the desired penetration resistance. While the use of these materials for the aprons accomplishes the specific purposes for which they are selected, such materials do not mitigate the first penetration or washability problems. Furthermore, while the choice of materials may reduce the weight of an apron to increase the shoer's comfort, it does not eliminate any need for having multiple aprons available in case an apron becomes unserviceable by reason of a thigh pad penetration. Such a concern might make it necessary to pack one or more extra aprons in airplane baggage, compounding any weight limitation problems.

It is, therefore, a primary object of this invention to provide an improved shoeing apron. Another object of this invention is to provide a shoeing apron which resists penetration by a shoeing tool. It is also an object of this invention to provide a shoeing apron which is not rendered unserviceable by a single penetration of a shoeing tool. A further object of this invention is to provide a shoeing apron which is lighter than a leather apron. Still another object of this invention is to provide a shoeing apron which is more comfortable than a leather apron. Yet another object of this invention is to provide a shoeing apron which is less expensive than a leather apron. It is also an object of this invention to provide a shoeing apron which is washable. A further object of this invention is to provide a shoeing apron which reduces the need for having multiple aprons available in case an apron becomes unserviceable by reason of a thigh pad penetration.

SUMMARY OF THE INVENTION

In accordance with the invention, a protective garment is provided for use in activities such as shoeing or otherwise tending to the hooves of animals, cutting timber and other activities in which there is a likelihood that a tool might puncture the thigh portion of a person's clothing. An apron has a waistband and a pair of thigh coverings which extend downwardly from the front of the waistband. A pair of puncture-resistant pads are sized, each one to at least partially cover a respective one of the thigh coverings. One component of an attachment mechanism is fixed on each covering and its complemental component is fixed on its corresponding pad. The complemental components can be connected and disconnected to and from each other to position the pads on or remove the pads from the apron. Preferably, several such mechanisms are spaced along the perimeter of the pad.

Preferably, the apron is washable and made of an air permeable material which is lightweight in comparison to the material of the pads, which are preferably leather. The pads are further preferably identically shaped, and most preferably symmetrical about vertical and horizontal axes, with the attachment mechanisms positioned on the coverings and on the pads so that the pads are interchangeable on the coverings. The complemental attachment mechanisms may, for example, be segments of hook and loop material, buttons and button holes or mating zipper teeth. The waistband is equipped with a mechanism for securing the waistband about the waist of the user and the coverings are equipped with mechanisms for securing the coverings about the thighs of the user.

BRIEF DESCRIPTION OF THE DRAWINGS

Other objects and advantages of the invention will become apparent upon reading the following detailed description and upon reference to the drawings in which:

FIG. 4 is a front elevation view of a pair of damaged thigh pads square on the shoeing apron; and.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

Figure 1:
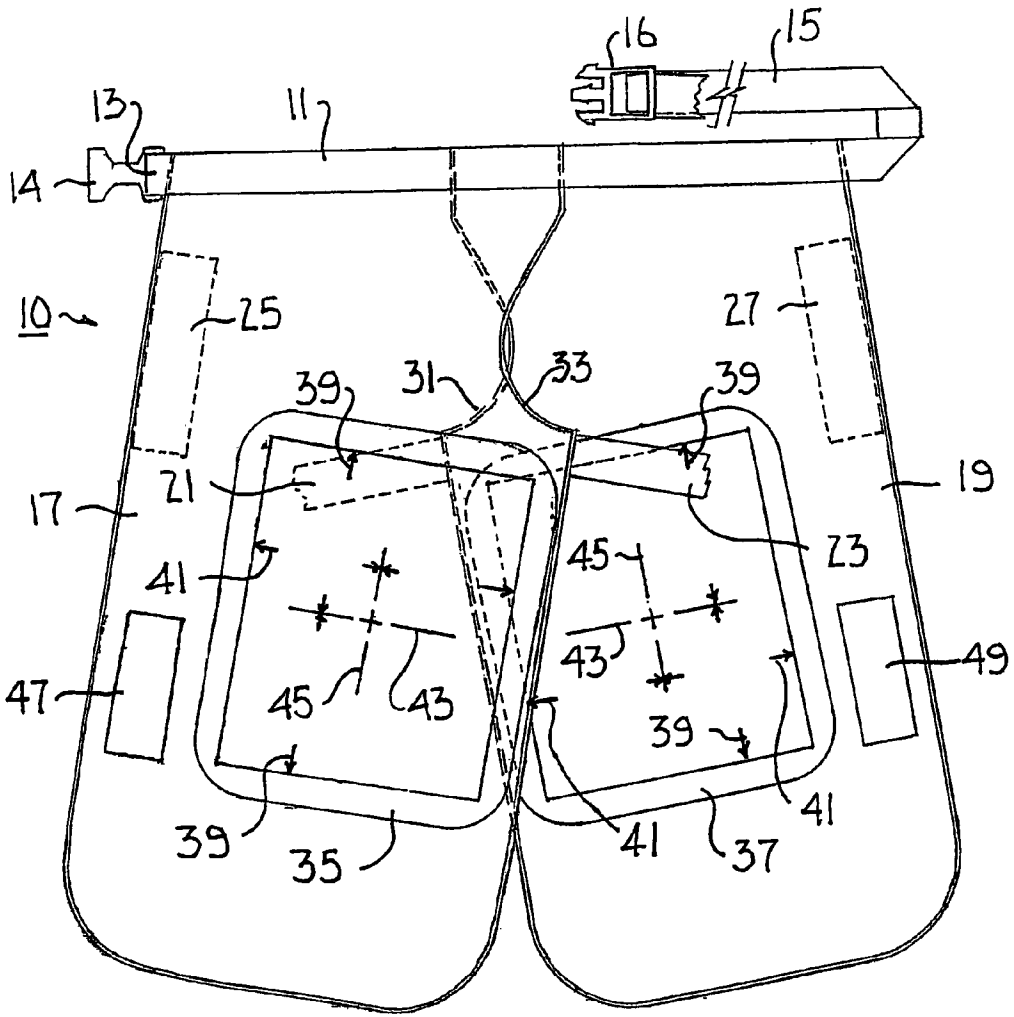
FIG. 1 is a front elevation view of a shoeing apron in accordance with the invention.

Looking first at FIG. 1, a horse shoeing apron 10 in accordance with the present invention is illustrated. The apron 10 has a waistband 11 with a pair of ties or extensions 13 and 15. The waistband 11 is long enough to extend across the front of the shoer's waist and the ties or extensions 13 and 15 are long enough to tie or buckle 14 and 16 behind the shoer's back or to wrap around the shoer's waist to tie in front of the shoer. The apron 10 also has a pair of thigh coverings 17 and 19 which extend downwardly from the waistband 11. Each thigh covering 17 or 19 has a pair of ties or, as shown, a strap 21 or 23 and a hook and loop connector 25 or 27. The covering 17 and 19 are narrowed 31 or 33 above the straps 21 and 23 to facilitate manipulation of the coverings 17 and 19. The connectors 25 and 27 are on the back side of the coverings 17 and 19 so that the straps 21 and 23 will extend under the coverings 17 and 19. The straps 21 and 23 are long enough to wrap behind the shoer's leg to secure their coverings 17 or 19 against the fronts of the shoer's thighs. The thigh coverings 17 and 19 each have mating components 35 and 37, respectively, such as segments of hook or loop materials fixed on their front face. As shown, the components 35 and 37 are preferably arranged on their respective coverings 17 and 19 at equal distances 39 and 41 from both the "x" and "y" axes 43 and 45, for reasons hereinafter explained. The coverings 17 and 19 also have segments of hook or loop material on their front outer edges. Preferably, the apron 10 is washable and made of an air permeable material.

Figure 2:
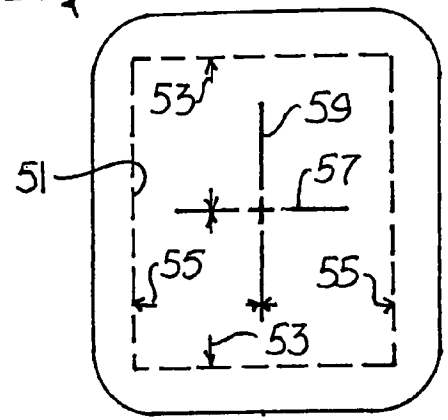
FIG. 2 is a front elevation view of a typical thigh pad for use with the apron of FIG. 1.

Turning to FIG. 2, a typical pad 50 for use with the apron 10 is illustrated. The pad 50 as shown is rectangular and has mating components 51 on its rear face, such as segments of loop or hook material which are complementary to the mating components 35 and 37 on the thigh coverings 17 and 19. The pad mating components 51 are arranged approximately along the edges of the pad 50 at equal distances 53 and 55 from both the "x" and "y" axes 57 and 59. The distances 53 and 55 from the pad axes 57 and 59 are the same as the distances 39 and 41 from the covering axes 43 and 45, so that a pad 50 can be laid over a covering 17 or 19 with complementary mating components 35 or 37 and 51 aligned for attachment. By complementary, it is intended that the thigh covering components 35 and 37 may be attached to their respective pad components 51 to secure the pad 50 to a thigh covering 17 or 19. The complementary components 35 or 37 and 51 may, as shown, be segments of hook and loop material, or may be buttons and button holes, laces and eyelets, mating zipper teeth or the like. The pad 50 is made of puncture-resistant material, such as leather, which is heavyweight in comparison to the material of the apron 10.

Figure 3:
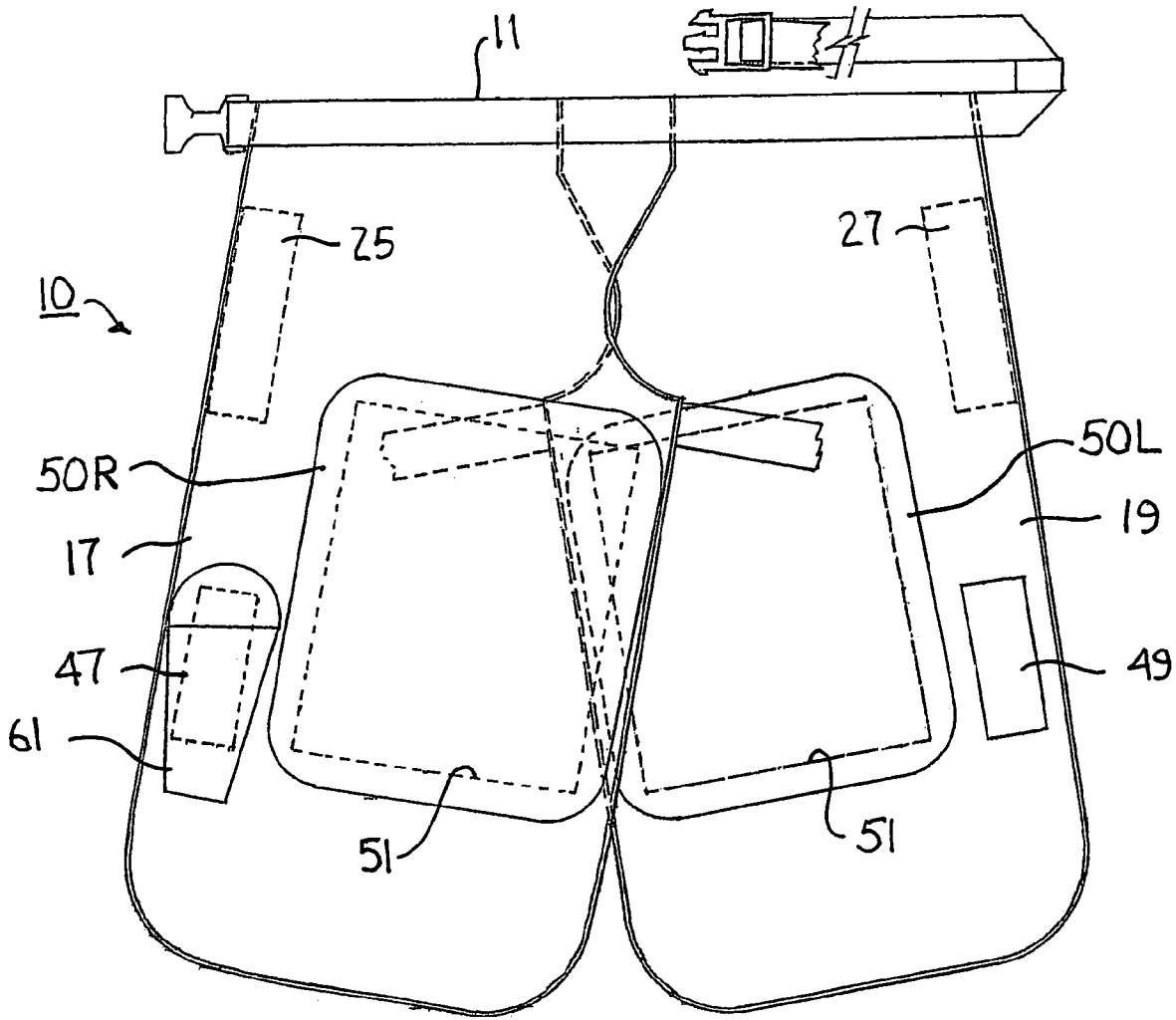
FIG. 3 is a front elevation view of a pair of thigh pads of FIG. 2 attached to the shoeing apron of FIG. 1.

Looking now at FIG. 3, an apron 10 is illustrated with a pair of pads 50L and 50R mounted on the thigh coverings 17 and 19. While the pads 50 shown are rectangular, the pads may be of any shape suitable to protect the thigh, and need not be identically shaped. As long as the mating components 51 on the pads 50L and 50R are positioned on their respective pads 50 at distances 53 and 55 equal to the positioning distances 39 and 41 of the covering mating components 35 or 37, the pads 50 can be switched between thigh coverings 17 and 19 and or inverted. If the distances 39, 41, 53 and 55 are equal, the pads 50 can be rotated 90 degrees on a thigh covering 17 or 19 or replaced by another pad 50 in any rectilinear orientation. It may be desirable that the pads 50 merely be replaceable. If so, the components 35 or 37 and 51 need only be positioned for alignment and not for rotation. It may be desirable that the pads 50 also be invertible. If so, the components 35 or 37 and 51 need only be positioned for alignment and for 180 degree rotation. One or more detachable tool holders 61 may also be adhered to the segments 47 and/or 49 of connecting material on the outer edges of the coverings 17 and/or 19.

Figure 4:
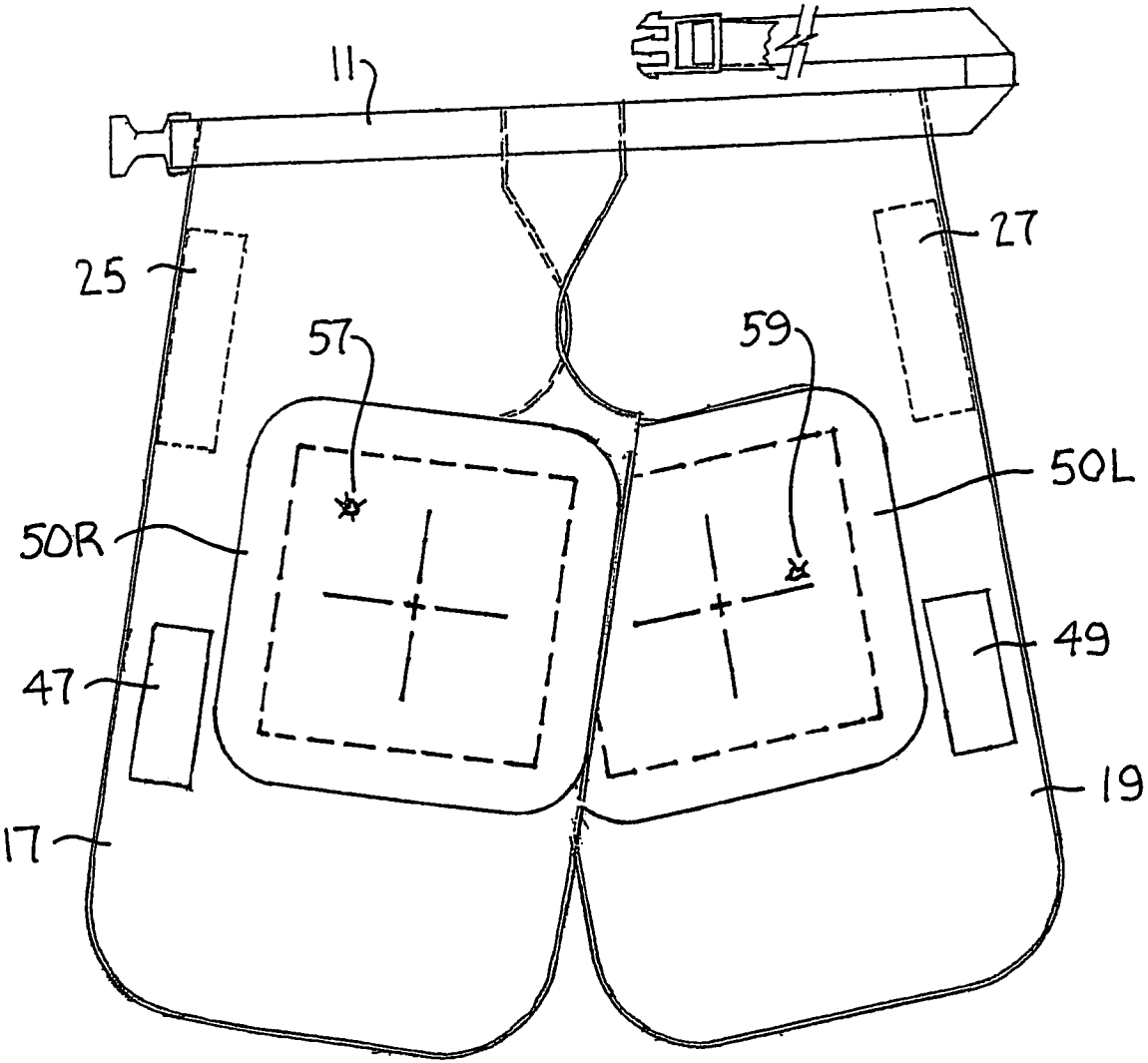
Figure 5:
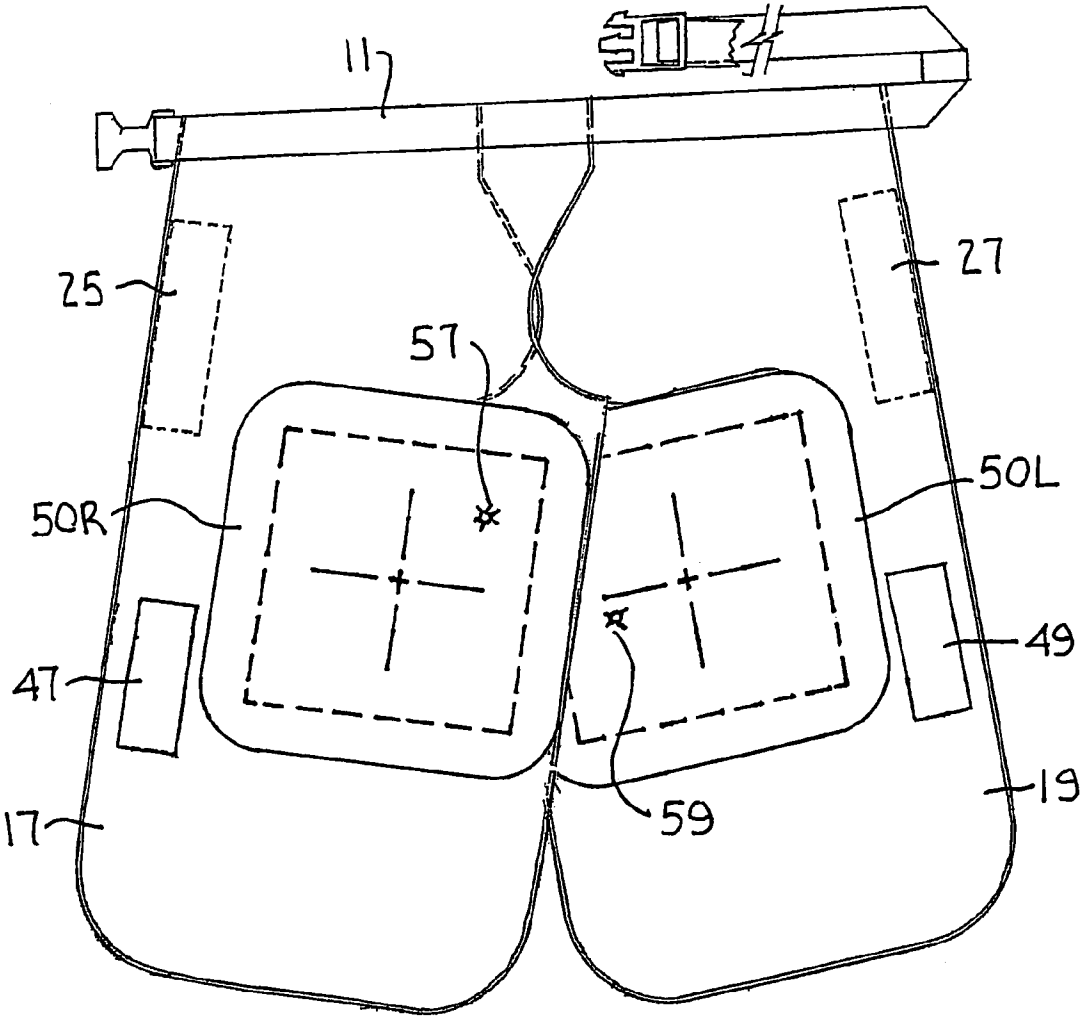
FIG. 5 is a front elevation view of the damaged thigh pads of FIG. 4 rotated to reorient the damaged areas on the shoeing apron.

The advantage of 90 degree rotation, which can be achieved by use of square pads 50, is illustrated in reference to FIGS. 4 and 5. In FIG. 4, the left and right pads 50L and 50R have high left and center right punctures 57 and 59, respectively. The pads 50L and 50R must be replaced or reoriented to reduce the risk that the next puncture, which is likely to occur at one of the already punctured locations on the coverings 17 and 19, will penetrate the shoer's thigh. In FIG. 5, the left pad 50L has been rotated 90 degrees and the right pad 50R has been inverted. This illustration demonstrates that, depending on the type of symmetry employed for the mating components 35, 37 and 51 and the likely location for a puncture in that symmetry, the pads 50L and 50R may be reoriented many times and even switched and reoriented before it becomes necessary to replace them.

Thus, it is apparent that there has been provided, in accordance with the invention, a protective covering that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For protecting hoof-supporting portions of thighs of a person against puncture by a pointed tool used by the person in shoeing an animal, a garment comprising:

an apron having a waistband and a pair of coverings, each said covering extending downwardly from a front of said waistband and over and below the hoof supporting-portion of a respective one of the thighs;

a pair of puncture-resistant pads, one for each said covering, each said pad sized to cover the hoof-supporting portion of its respective said covering; and first means on each said covering and second means on each said pad, said first and second means being complemental to each other for securing each of said pads to its respective said covering with said pads overlying the hoof-supporting portions of their respective said coverings.

2. A garment according to claim 1, said apron being washable.

3. A garment according to claim 1, said coverings being made of material which is lightweight in comparison to material of said pads.

4. A garment according to claim 1, said coverings being made of material which is air permeable.

5. A garment according to claim 1, said pads being made of leather.

6. A garment according to claim 1, said pads being identically shaped.

7. A garment according to claim 6, said pads being symmetrical about a vertical axis.

8. A garment according to claim 7, said pads being symmetrical about a horizontal axis.

9. A garment according to claim 1, said first means being positioned on said coverings and said second means being positioned on said pads so that said pads are interchangeable on said coverings.

10. A garment according to claim 1, said complemental means being segments of hook and loop material.

11. A garment according to claim 1, said complemental means being buttons and button holes.

12. A garment according to claim 1, said complemental means being mating zipper teeth.

13. A garment according to claim 1, said waistband having means for securing said waistband about a waist.

14. A garment according to claim 1, said coverings having means for securing said coverings about respective thighs.

15. For protecting hoof-supporting portions of thighs of a person against puncture by a pointed tool used by the person in shoeing an animal, a garment comprising:

an apron having a waistband and a pair of coverings, each said covering extending downwardly from a front of said waistband and over and below the hoof supporting-portion of a respective one of the thighs;

a pair of puncture-resistant pads, one for each said covering, each said pad sized to cover the hoof-supporting portion of its respective said covering; and first means on each said covering and second means on a perimeter of each said pad, said first and second means being complemental to each other for securing each of said pads along its perimeter to its respective said covering with said pads overlying the hoof-supporting portions of their respective said coverings.

16. A garment according to claim 15, each of said pads being generally quadrilateral and each said second means extending along opposite sides of its respective said pad.

17. A garment according to claim 16, each said second means extending along four sides of its respective said pad.

* * * * *